US005143315A

United States Patent [19]

Faessel et al.

[11] Patent Number: 5,143,315

[45] Date of Patent: Sep. 1, 1992

[54] METHOD AND DEVICE FOR FORMING COILS OF METAL WIRE

[75] Inventors: André Faessel; Claude Pochon, both of Metz; Jean-Pierre Mazzocco, Mexi; Jean-Claude Valetti, Ugny, all of France

[73] Assignee: Unimetal, Metz, Cedex 1, France

[21] Appl. No.: 644,219

[22] Filed: Jan. 22, 1991

[30] Foreign Application Priority Data

Feb. 12, 1990 [FR] France ..... 90 01713

[51] Int. Cl.[5] ..... B21C 47/02

[52] U.S. Cl. ..... 242/83

[58] Field of Search ..... 242/83, 82, 84

[56] References Cited

U.S. PATENT DOCUMENTS

| | | | |
|---|---|---|---|
| 3,747,869 | 7/1973 | Meyer | 242/83 X |
| 3,770,025 | 11/1973 | Hirschfelder et al. | 242/83 X |
| 4,145,014 | 3/1979 | Chatard et al. | 242/83 |
| 4,747,557 | 5/1988 | Fujimaki | 242/83 |

FOREIGN PATENT DOCUMENTS

| | | | |
|---|---|---|---|
| 3819982 | 12/1989 | Fed. Rep. of Germany . | |
| 1383930 | 4/1965 | France . | |
| 2057934 | 4/1971 | France . | |
| 2105309 | 4/1972 | France . | |
| 55-145972 | 11/1980 | Japan | 242/83 |
| 759575 | 10/1956 | United Kingdom . | |

*Primary Examiner*—John M. Jillions

*Attorney, Agent, or Firm*—Frishauf, Holtz, Goodman & Woodward

[57] ABSTRACT

In this method preformed turns of the wire are made to fall into a coil-forming pit having a substantially cylidrical wall with a vertical axis where they are superimposed and form a coil. In the course of the fall of the turns, there is exerted on the latter a radial force of attraction toward the wall of the pit, the direction of this force undergoing a motion of rotation about the axis of the pit. The force of attraction is preferably produced by a rotating magnetic field. For this purpose, the device comprises means for exerting on the turns said force undergoing a motion of rotation, these means comprising inductors such as electromagnets (5) which are evenly spaced apart on the periphery of the pit, and means for cyclically feeding dc current to these electromagnets. The invention is applied to the forming of coils of wires of magnetic metal, in particular steel.

19 Claims, 1 Drawing Sheet

METHOD AND DEVICE FOR FORMING COILS OF METAL WIRE

FIELD OF THE DESCRIPTION

The present invention relates to a method and device for forming a coil of metal wire, in particular steel wire, of the type in which preformed turns or helices of said wire are made to fall into a forming pit which has a cylindrical wall with a vertical axis and an inside diameter larger than the diameter of the turns and in which said turns accumulate and constitute the coil.

DESCRIPTION OF THE PRIOR ART

Devices of this type are in particular employed in installations for drawing metal wires and forming coils which are thereafter compacted and tied up. In such installations, after the drawing operation, the wire is preformed into turns which are then disposed substantially flat in overlapping relation to one another on a cooling conveyor which is usually provided and on which the turns of the wire are cooled in the course of the displacement of the conveyor.

At the end of the conveyor, the turns of wire fall one after the other into a pit having a cylindrical wall and a vertical axis, the diameter of the wall being slightly larger than that of the turns where they pile up and form a coil which is subsequently extracted from the pit for compacting and tying up before storage or utilization.

Such an installation is in particular disclosed in the documents FR-A-1 383 950; FR-A-2 057 934 and FR-A-2 105 309.

In such installations, the turns, notwithstanding the fact that they are partly guided by an axial upwardly tapered post inside the pit, have a tendency to be deposited one on top of the other in a disorderly manner. Consequently, the height of the coil formed in this way is much greater than if the turns were piled one on top of the other in a well-ordered manner.

As mentioned before, the coils are subsequently compacted by exerting an axial pressure on the latter. As the turns are disposed in a disorderly manner, the wires cross in many places and, when the coil is compacted, there is great risk of damage to the wire in the region of the crossing points.

SUMMARY OF THE INVENTION

An object of the present invention is to overcome these problems and to propose a system for forming a coil which permits disposing the turns in an orderly manner, reducing the overall size of the coils and avoiding damage to the wire.

For these purposes, the invention provides a method for forming coils of wire of the type indicated hereinabove, this method being characterized in that, in the course of the fall of the turns into the pit, there is exerted on the turns a radial force of attraction toward the wall of the pit, the direction of this force undergoing a motion of rotation about the axis of the pit.

The invention also provides a device for forming coils of metal wire previously put into the form of turns, comprising a pit for forming the coil which has a cylindrical wall with a vertical axis. According to the invention, the device is characterized in that it comprises means for exerting on said turns a centrifugal radial force undergoing a motion of rotation about the axis of the pit.

As will have been no doubt understood, the method and the device according to the invention permit arranging the turns in the coil in the course of formation in an orderly manner so that they are disposed in superimposed layers, the turns of each layer being angularly offset from one another. In other words, each turn, or group of turns, is substantially in contact with the wall of the pit at a point and the respective points of contact of two successive turns, or groups of turns, are evenly offset circumferentially. The opening out of the turns is in this way optimized when forming the coils. There is consequently a substantial saving, for a given length of wire, in the height of the coils and therefore in the overall size of the latter. Further, as the turns are evenly arranged in the coils, the latter have an improved behavior and there is less risk of the coils becoming deformed upon handling. As the coils formed in this way are more compact, the subsequent compacting operations may be reduced and even done away with which may result in the elimination of the compacting devices and therefore in a reduction in the production time and cost, or in any case in a reduction in the risk of damage to the wire during compacting.

In a particular arrangement of the invention, the method is applied to the forming of coils of metal wire which may be attracted by a magnet, and the force of attraction of the turns is produced by a rotating magnetic field, this magnetic field being preferably produced by inductors such as electromagnets evenly spaced apart on the periphery of the coil-forming pit and supplied with dc current in cycles.

With this arrangement, the cyclic attraction of the turns of metal toward the wall of the coil-forming pit may be achieved in a very simple manner without use of mechanical elements inside the pit.

The use of a magnetic field produced by electromagnets moreover permits easily regulating the magnitude of the force of attraction and the speed of rotation of the rotating field in accordance with the diameter of the wire, the dimensions of the turns and the speed of the conveyor conveying the turns and also the speed at which the turns fall into the pit.

Further, the use of electromagnets placed outside the pit permits easily adapting the method of the invention in existing installations without extensive modifications in the pit, since it is merely necessary to make the wall of the pit in the region of the electromagnets from a non-magnetic material.

Further features and advantages of the invention will be apparent from the following description which will be given as an example of a device and of the method according to the invention applied to the forming of coils of steel wire at the output end of a wire-drawing bench.

BRIEF DESCRIPTION OF THE DRAWINGS

Reference will be made to the accompanying drawings in which.

DESCRIPTION OF THE EMBODIMENTS

Figure 1:
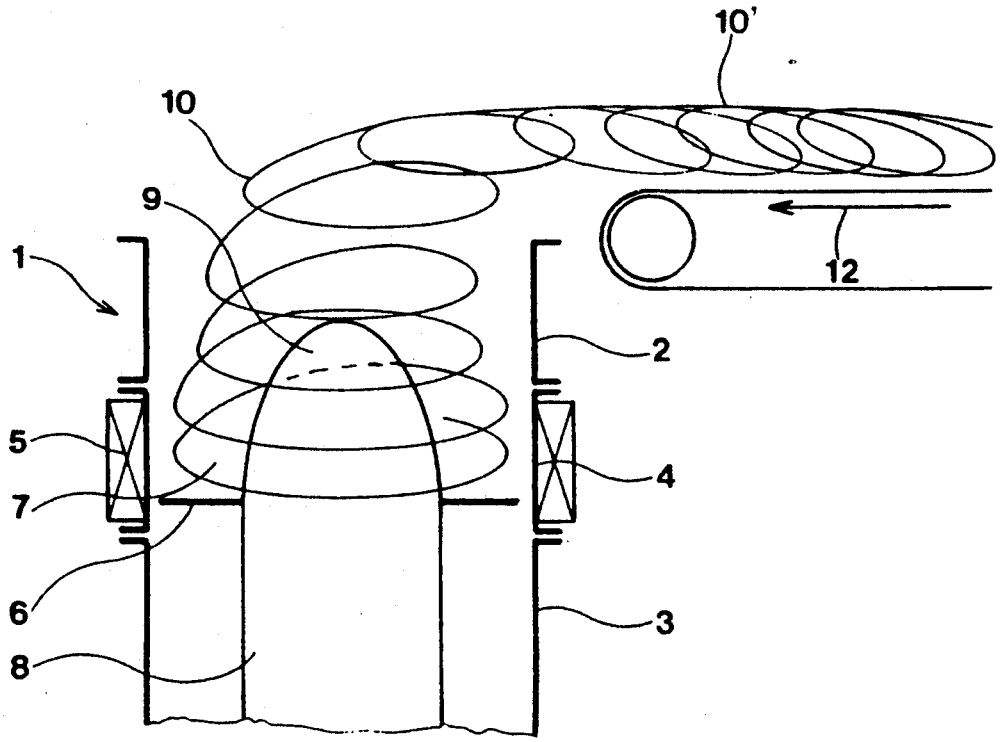
FIG. 1 is a diagrammatic axial sectional view of a coil-forming device according to the invention.
Figure 2:
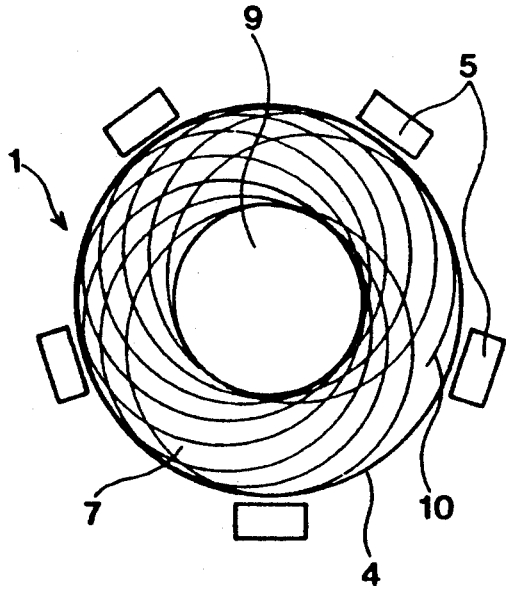
FIG. 2 is a top plan view of this device.

The device shown in FIGS. 1 and 2 comprises a pit or shaft 1 for forming coils of steel wire whose wall is cylindrical and has a vertical axis. This wall comprises:

an upper sleeve 2 whose upper part may be slightly flared so as to form a receptacle for turns or helices of wire 10 fed thereto by a conveyor 11 which is driven in the direction of the arrow 12 and on which the wire is disposed in turns or helices 10' which are substantially in a flat state and partly overlap one another;

a lower sleeve 3 which acts as guiding and maintaining means for the formed coil of wire and is provided with means (not shown) for extracting the coil from the pit;

an intermediate sleeve 4 composed of a non-magnetic material.

Electromagnets 5, five in number in the illustrated embodiment, are spaced apart circumferentially on the periphery of the intermediate sleeve 4 to which they are fixed. The height of the electromagnets 5 is slightly lower than the height of the intermediate sleeve 4 so that substantially all the lines of force of the magnetic field produced by the electromagnets in operation cross said intermediate sleeve.

Located inside the pit 1 is a vertically movable horizontal tray 6, its upper position being located at the level of the intermediate sleeve 4. This tray is adapted to support the coil 7 and is progressively lowered so that the upper part of the coil being formed permanently remains in the zone of action of the field produced by the electromagnets 5. In FIG. 1, the device is shown at the beginning of the formation of the coil 7, the latter being constituted only by a few turns of wire 10 deposited on the tray 6 in the upper position of the latter.

The tray 6 is annular and surrounds a central mandrel 8 which terminates in an upper curved tapered end 9 adapted to provide an additional guidance to the turns 10 of wire when they fall into the pit 1 and in particular to ensure that the turns do not drop on a bias and disturb the formation of the coil. The tapered end 9 which is located at the height of the intermediate sleeve 4 is preferably made from a non-magnetic material. However, this tapered end is not indispensable, in particular when coiling wire of large diameter, owing to the fact that the use of the method according to the invention has for effect to guide the fall of the turns and to ensure their positioning in the coil in an orderly manner.

Figure 3:
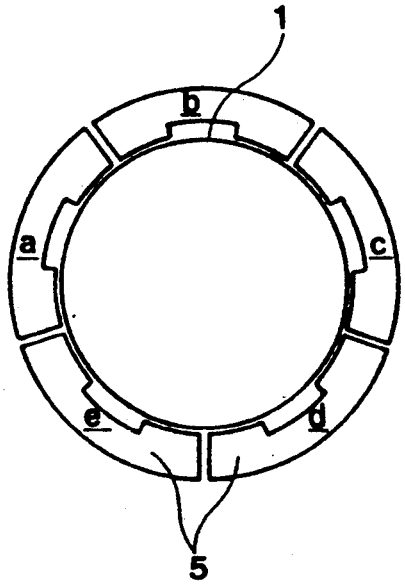
FIG. 3 is a diagrammatic top plan view of a particular arrangement of electromagnets.

In the arrangement shown in FIG. 3, the electromagnets 5 are disposed "horizontally", i.e. in such manner that the general direction of the lines of force of the field which extend between the two poles of a given electromagnet are in a horizontal plane. For this purpose, electromagnets may be arranged in accordance with the diagrammatic representation in FIG. 3, the magnetic yoke of the electromagnets having a U-shape and the poles formed by the ends of the branches of the U extending vertically through a height slightly less than that of the non-magnetic sleeve 4 and being mounted on the outer surface of the latter.

As a variant, the electromagnets may be disposed "vertically", i.e. in such manner that the lines of force of the field have a generally vertical direction.

The electromagnets 5 and the means supplying electric current are so arranged that the effect of the field produced by each electromagnet on the turns is essentially localized in the part of the annular zone between the intermediate sleeve 4 and the tapered end 9 and located in facing relation to said electromagnet.

In other words, the force of attraction exerted by an electromagnet on the turn or turns located at its level at the moment it is fed with electric current is only exerted on the portion of the arc of this turn or turns which is closest to said electromagnet.

It is recalled that in this type of installation, the inside diameter of the pit is larger than that of the turns. For example, the diameter of the pit is 1,150 mm and that of the turns about 1,050 mm. Each turn has a freedom of horizontal movement inside the pit of about 100 mm. When one of the electromagnets is excited, the turn or turns in the course of their fall which are located at the height of the intermediate sleeve 4 can therefore be located in a position remote from the wall of the sleeve facing said electromagnet by about 100 mm, or even more when it is considered that the turns may be inclined to the horizontal. For these turns to be subjected to the attraction exerted by this electromagnet the field generated by the latter must penetrate the interior of the pit to a depth which is at least equal to this distance, namely, in the case considered hereinbefore, about 150 mm.

It will be easily understood that the depth of penetration of the magnetic field in the pit will have to be adapted in particular in accordance with the diameters of the pit and turns and also in accordance with the presence or the absence of the tapered end and the diameter of the latter.

Further, in order to cause the magnetic field to rotate about the axis of the pit, the device comprises means (not shown) for cyclically feeding dc current to the electromagnets 5. These means permit feeding current to the electromagnets in a plurality of different cycles. For example, with reference to FIG. 3 in which the electromagnets carry respectively the reference letters a, b, c, d, e, it is possible to feed current to only a single electromagnet at a time and achieve a feeding cycle in the order a, b, c, d, e, a . . . or in the order a, c, e, b, d, a . . . It is also possible to feed current to two electromagnets, preferably neighbouring electromagnets simultaneously for example in accordance with one of the following cycles:

| |
|---|
| a + b, c + d, e + a, b + c, d + e . . . |
| a + b, b + c, c + d, d + e, e + a . . . |
| or again a + c, b + d, c + e, d + a, e + b . . . |

The direction of rotation may also be reversed.

The manner in which the coil-forming device is used will now be described. Before the turns or helices conveyed by the conveyor 11 arrive, the electromagnets 5 are fed with current in accordance with one of the previously-determined cycles.

The tray 6 is brought to its upper position shown in FIG. 1 at the height of the intermediate sleeve 4. The first turns 10 fall into the pit 1 and onto the tray 6. It should be mentioned that, in the case where the device is adapted to an installation of the type disclosed in the aforementioned document FR 2 105 309 (from which any required additional information may be obtained), the first turns may be disposed on retractable pins which extend into the pit and support the coil while a waiting the return of the tray to the upper position, these pins then being retracted to enable the coil being formed to rest on the tray.

As they fall, the turns of wire are attracted by the electromagnets 5 and, owing to the cyclic feeding of the latter which produces a rotating magnetic field, the turns are circumferentially distributed in partly overlapping one another as shown in FIG. 2. As the turns are progressively deposited and the height of the coil increases, the descent of the tray 6 is so controlled that the upper part of the coil being formed remains at the level of the intermediate sleeve and in this way continues to be subjected to the action of the magnetic field.

Preferably, the descent of the tray is so adjusted as to maintain the upper part of the coil in proximity to the bottom of the zone of action of the electromagnets. In this way the field will have a preponderant effect on the falling turns, the required force of attraction on said turns being then relatively small. The field will however have an effect on the turns which have just been deposited, which will prevent a possible displacement of the latter which could result for example from the elasticity of the turns. As the subjacent turns are outside the field, there is however no risk of these turns being displaced owing to the pressure exerted on the latter by the upper turns.

When all the turns have been deposited and the coil is completely formed, the tray is lowered to the lower position and the coil is discharged.

As will have been understood, it is owing to the regular arrangement of the turns that the height of the coil is notably reduced relative to the heights of coils produced in the prior art in which the turns are distributed with no regularity and are superimposed in a random manner.

As an example, in the case of the installation described hereinbefore, used at the output end of a mill producing wire 5.5 mm in diameter preformed into turns 1,050 mm in diameter falling into the pit at a rate of the order of 25 turns/second, each electromagnet is fed with dc current and operates at about 40,000 ampere-turns in the coil. Five electromagnets are employed and fed in succession, the field created rotating at a speed of about 0.25 revolutions per second.

It was possible to obtain a reduction in the height of the coil of more than 30%.

It must be mentioned that the speed of rotation of the field may vary within large proportions as a function in particular of the chosen cycle of feeding the electromagnets, the dimensional characteristics of the wire and the speed at which the turns fall. It also depends on the time required for the power to build up in the electromagnets, which implies a minimum duration of the feeding of current to the latter so that the magnetic field created can produce a sufficient effect of attraction on the turns.

Further, account must be taken of the remanent magnetization of the electromagnets which results in a delay in the disappearance of the magnetic field with respect to the moment at which the feeding of current thereto is cut off; therefore a duration of the feeding cycle must be sufficient to ensure that the field effects created by different electromagnets do not disturb or cancel out one another.

For this purpose, the electromagnets are preferably so disposed that the adjacent poles of two neighbouring electromagnets have the same polarity. For the same purpose, the electromagnets will be preferably fed with current in accordance with a cycle in which one electromagnet is fed and then, not the adjacent electromagnet but the following electromagnet, is fed, and so on.

Likewise, in order to reduce the time of response of the electromagnets, a certain voltage, for example about 90 V, could be permanently maintained in the electromagnets which is insufficient to create the effect of attraction but permits reducing the time for building up power upon the cyclic feeding of the magnets at the working voltage, on the order of 200 V in the present case.

The scope of the invention is not intended to be limited to the device and method described hereinbefore by way of examples.

In particular, the number of magnets may be modified and the latter could be disposed in such manner that the adjacent poles of two adjacent electromagnets have the same polarity or opposite polarities. It will be observed that, in the case of adjacent poles of the same polarity, the number of magnets will be preferably an even number in order to avoid a discontinuity in the distribution of the poles.

The rotating magnetic field could also be produced by any means known to those skilled in the art in the electromagnetism field, for example by employing polyphase inductors or a yoke and turns similar to those of a stator of an electric motor which are fed with dc current or otherwise.

The magnetic field could also exert its action on a more or less great height and at a level which is more or less close to the upper end of the pit, the respective heights of the intermediate or upper sleeves being correspondingly adapted.

What is claimed is:

1. A method for forming a coil of magnetizable metal wire, comprising:

causing preformed turns of said wire to fall into a forming pit, said pit having a substantially cylindrical wall with a vertical axis, said turns of said wire being caused to fall into said pit so that said turns are superimposed on one another and form a coil, and exerting on said turns during the fall of said turns into the forming pit a radial force of attraction that acts in a direction toward said cylindrical wall of said pit while causing said direction of said radial force of attraction to rotate about said vertical axis.

2. The method according to claim 1, further comprising:

producing said force of attraction by means of a rotating magnetic field.

3. The method according to claim 2, comprising:

producing said rotating magnetic field by means of electromagnets evenly spaced apart on a periphery of said pit; and feeding said electromagnets with a dc current in a cyclic manner.

4. The method according to claim 3, comprising feeding said dc current to a single one of said electromagnets at a time.

5. The method according to claim 3, comprising simultaneously feeding said dc current to two of said electromagnets.

6. The method according to claim 5, wherein said two electromagnets are positioned adjacent to each other.

7. The method according to claim 1, comprising:

exerting said force of attraction at a level of said forming pit which corresponds to an upper part of said coil being formed.

8. The method according to claim 1, comprising exerting said force of attraction on the falling turns at a position above an upper level of said coil being formed.

9. The method according to claim 1, wherein the magnetizable metal wire comprises a steel wire.

10. The method according to claim 1, wherein the rotating radial force of attraction will cause a first falling turn of said wire to be moved to contact the cylindrical wall of the pit at a given point, and will cause subsequent falling turns to contact the cylindrical wall of the pit at successive other points, said successive other points being circumferentially offset from the given point on the cylindrical wall.

11. A device for forming a coil of magnetizable metal wire, that has previously been shaped into turns, said device comprising:

a pit for forming said coil, said pit having a cylindrical wall with a vertical axis, and said pit receiving therein a number of turns of said metal wire; and means for exerting on said turns received in said pit, a radial force of attraction acting in a direction toward said cylindrical wall of said pit; and means for causing said radial force of attraction to rotate about said vertical axis of said pit.

12. The device according to claim 11 wherein said means for exerting said radial force comprises inductors capable of producing a rotating magnetic field.

13. The device according to claim 12, wherein:

said inductors comprise electromagnets evenly spaced apart on a periphery of said pit;

said device further comprising means for cyclically feeding a dc current to said electromagnets.

14. The device according to claim 12, wherein said cylindrical wall of said forming pit at a level where said inductors are positioned comprises a non-magnetic material.

15. The device according to claim 11, wherein said means for exerting said radial force is positioned at a level of said forming pit that corresponds to an upper part of said coil being formed.

16. The device according to claim 11, wherein said means for exerting said radial force is positioned above a level of said forming pit that corresponds to an upper part of said coil being formed.

17. The device according to claim 11, wherein said means for exerting said radial force is positioned at both a level of the forming pit that corresponds to an upper part of said coil being formed and a level that is above the level that corresponds to the upper part of said coil being formed.

18. The device of claim 11, wherein said magnetizable metal wire comprises a steel wire.

19. The device of claim 11, wherein the rotating radial force of attraction will cause a first falling turn of said wire to be moved to contact the cylindrical wall of the pit at a given point, and will cause successive falling turns to contact the cylindrical wall of the pit at successive other points, said successive other points being circumferentially offset from the given point on the cylindrical wall.

* * * * *